US011240588B2

(12) United States Patent
Ozawa et al.

(10) Patent No.: US 11,240,588 B2
(45) Date of Patent: Feb. 1, 2022

(54) SOUND REPRODUCING APPARATUS

(71) Applicant: SONY CORPORATION, Tokyo (JP)

(72) Inventors: Masataka Ozawa, Kanagawa (JP); Kazuhiro Sekine, Tokyo (JP); Jo Kamada, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/087,001

(22) PCT Filed: Dec. 28, 2016

(86) PCT No.: PCT/JP2016/089042

§ 371 (c)(1),
(2) Date: Sep. 20, 2018

(87) PCT Pub. No.: WO2017/168903

PCT Pub. Date: Oct. 5, 2017

(65) Prior Publication Data

US 2019/0104352 A1 Apr. 4, 2019

(30) Foreign Application Priority Data

Mar. 29, 2016 (JP) ..... JP2016-065866

(51) Int. Cl.
*H04R 25/00* (2006.01)
*H04R 1/10* (2006.01)
(Continued)

(52) U.S. Cl.
CPC ..... *H04R 1/105* (2013.01); *H04R 1/24* (2013.01); *H04R 11/02* (2013.01); *H04R 1/10* (2013.01); *H04R 3/14* (2013.01); *H04R 2460/13* (2013.01)

(58) Field of Classification Search
CPC ..... H04R 1/24; H04R 1/26; H04R 25/606; H04R 2460/13; H04R 1/1041
See application file for complete search history.

(56) References Cited

U.S. PATENT DOCUMENTS 4,821,323 A * 4/1989 Papiernik ..... H04R 1/1066 381/151
6,603,863 B1 * 8/2003 Nagayoshi ..... H04R 1/1066 381/370
8,699,742 B2 * 4/2014 Heiman ..... H04S 7/301 381/151
(Continued)

FOREIGN PATENT DOCUMENTS

CN 1741682 A 3/2006
CN 105430569 A 3/2016
(Continued)

OTHER PUBLICATIONS

Extended European Search Report of EP Patent Application No. 16897118.2, dated Feb. 22, 2019, 09 pages.
(Continued)

*Primary Examiner* — Ryan Robinson
(74) *Attorney, Agent, or Firm* — Chip Law Group

(57) ABSTRACT

Provided is an ear-hole open type sound reproducing apparatus which can obtain good sound quality over a wide band while adopting a bone conduction system. A first equalizer 303 removes a high range component which is difficult to be reproduced by a vibration speaker 301 and is hard to be conveyed by bone conduction. Then, the vibration speaker 301 outputs the sound over a low range to a middle range by bone conduction sound. By equalizing processing of the first equalizer 303, it is also possible to reduce sound leakage of the high range. On the other hand, a second equalizer 304 removes components over the low range to the middle range. Then, an air conduction speaker 302 outputs high quality sound of the high range component by air conduction sound.

10 Claims, 12 Drawing Sheets

(51) Int. Cl.

| | |
|---|---|
| ***H04R 1/24*** | (2006.01) |
| ***H04R 11/02*** | (2006.01) |
| *H04R 3/14* | (2006.01) |

(56) References Cited

U.S. PATENT DOCUMENTS

| | | | | |
|---|---|---|---|---|
| 8,855,328 | B2 * | 10/2014 | Arie | H04R 5/04 381/71.11 |
| 9,020,168 | B2 * | 4/2015 | Karkkainen | H04R 1/1075 381/151 |
| 9,344,784 | B2 * | 5/2016 | Wen | H04R 1/02 |
| 9,426,556 | B2 * | 8/2016 | Boni | H04R 1/1041 |
| 9,684,335 | B2 * | 6/2017 | Kim | F16M 13/04 |
| 9,788,097 | B2 * | 10/2017 | Bullen | H04R 1/1041 |
| 9,930,436 | B2 * | 3/2018 | Fukuda | H04R 1/24 |
| 9,990,172 | B2 * | 6/2018 | Komaromi | H04R 1/1066 381/151 |
| 10,142,735 | B2 * | 11/2018 | Jan | A44C 7/00 381/322 |
| 10,277,971 | B2 * | 4/2019 | Gerber | F16M 13/04 |
| 2002/0012441 | A1 * | 1/2002 | Matsunaga | A42B 1/245 381/381 |
| 2008/0112581 | A1 * | 5/2008 | Kim | H04R 1/1075 381/151 |
| 2011/0170723 | A1 * | 7/2011 | Ryann | A44C 7/00 381/322 |
| 2013/0051585 | A1 | 2/2013 | Karkkainen et al. | |
| 2015/0319526 | A1 | 11/2015 | Kunimoto et al. | |
| 2017/0026751 | A1 | 1/2017 | Suzuki et al. | |
| 2017/0041711 | A1 | 2/2017 | Inakoshi | |
| 2019/0075389 | A1 * | 3/2019 | Jan | H04R 5/04 381/71.11 |

FOREIGN PATENT DOCUMENTS

| | | | |
|---|---|---|---|
| CN | 106105255 | A | 11/2016 |
| EP | 3122062 | A1 | 1/2017 |
| JP | 2001-245384 | A | 9/2001 |
| JP | 2009-088942 | A | 4/2009 |
| JP | 2009-267900 | A | 11/2009 |
| JP | 4930382 | B2 | 5/2012 |
| KR | 10-2006-0043937 | A | 5/2006 |
| WO | 2013/030437 | A1 | 3/2013 |
| WO | 2015/040832 | A1 | 3/2015 |
| WO | 2015/141402 | A1 | 9/2015 |
| WO | 2015/162923 | A1 | 10/2015 |

OTHER PUBLICATIONS

Office Action in JP 2018-508399 dated Jul. 18, 2018.

International Search Report and Written Opinion of PCT Application No. PCT/JP2016/089042, dated Mar. 28, 2017, 09 pages of ISRWO.

Office Action for CN Patent Application No. 201680083887.2, dated Aug. 5, 2019, 06 pages of Office Action and 09 pages of English Translation.

Office Action for EP Patent Application No. 16897118.2, dated Jan. 7, 2020, 06 pages of Office Action.

Office Action for CN Patent Application No. 201680083887.2, dated Apr. 26, 2020, 11 pages of Office Action and 06 pages of English Translation.

Office Action for JP Patent Application No. 2018-508399, dated Mar. 2, 2021, 5 pages of Office Action and 5 pages of English Translation.

* cited by examiner

SOUND REPRODUCING APPARATUS

CROSS REFERENCE TO RELATED APPLICATIONS

This application is a U.S. National Phase of International Patent Application No. PCT/JP2016/089042 filed on Dec. 28, 2016, which claims priority benefit of Japanese Patent Application No. JP 2016-065866 filed in the Japan Patent Office on Mar. 29, 2016. Each of the above-referenced applications is hereby incorporated herein by reference in its entirety.

TECHNICAL FIELD

The technology disclosed in this specification is directed to a sound reproducing apparatus used by being worn on the ears of a viewer/listener, such as headphones or earphones, and more particularly relates to an ear-hole open type sound reproducing apparatus which adopts a bone conduction system.

BACKGROUND ART

A sound reproducing apparatus (headphones, earphones, or the like) of a bone conduction system, which directly transmits sound to a bone such as a skull, has been known (e.g., see Patent Document 1). The sound reproducing apparatus of the bone conduction system is used by, for example, pressing a vibration speaker against a skull in the vicinities of the temples. The bone transmits the sound as vibration and stimulates the organs of the inner ear such as the cochlea. Then, the cochlea converts the vibration into an electric signal to be conveyed to the brain.

Headphones and earphones of an air conduction system, which have already been widely spread, convert the sound from an air conduction speaker (driver unit) into vibration of air to be conveyed to the ears. Thus, many of the headphones and earphones of the air conduction system are structured to close the ear holes to prevent interference due to the ambient sound and sound leakage to the outside. Therefore, since it is difficult to hear the ambient sound when such headphones or earphones are worn, these headphones or earphones should not be used for safety reasons in a scene where not hearing the ambient sound is troublesome, and the use thereof is restricted by rules or the like in some cases.

On the other hand, since the sound reproducing apparatus of the bone conduction system transmits the sound to the bone, it is unnecessary to close the ear holes, and the sound reproducing apparatus can be configured as an ear-hole open type apparatus. According to the ear-hole open type sound reproducing apparatus, there is an advantage that it is possible to listen to the ambient sound naturally even during wearing or listening and watching. Therefore, it is possible to normally utilize human functions dependent on aural characteristics, such as spatial grasping, danger sensing and grasping of conversation and subtle nuances during conversation. Moreover, since the ear holes are not closed, the sound reproducing apparatus has an appearance that other people may speak to the wearer and does not hinder communication between people. Furthermore, since the sound reproducing apparatus of the bone conduction system is not worn on the ear holes, the sound reproducing apparatus has advantages that it is not affected by individual differences in size and shape of the ears or the like and good wearability can be obtained.

However, a vibration speaker which transmits sound as vibration to the bone has a narrow reproducible frequency band. Thus, the sound reproducing apparatus of the bone conduction system has a problem that it is inferior to the sound reproducing apparatus of the air conduction system in terms of sound quality. In addition, the bone conduction listening sound has a feature that the high frequency components attenuate when propagating through soft tissue with low eigenfrequency, such as cartilage and muscle. Thus, it is difficult for the sound reproducing apparatus of the bone conduction system to reproduce a high frequency range.

The sound reproducing apparatus of the bone conduction system also has a problem of sound leakage due to the vibration generated from the vibration speaker trembling a housing to which the vibration speaker is fixed.

CITATION LIST

Patent Document

Patent Document 1: Japanese Patent Application Laid-Open No. 2009-267900

SUMMARY OF THE INVENTION

Problems to be Solved by the Invention

An object of the technology disclosed in this specification is to provide an ear-hole open type sound reproducing apparatus which can obtain good sound quality over a wide band while adopting a bone conduction system.

Solutions to Problems

The technology disclosed in this specification has been made in light of the above problems, and a first aspect thereof is a sound reproducing apparatus including:

a vibration speaker configured to generate bone conduction sound;

a first equalizer configured to perform equalizing processing on a signal input into the vibration speaker;

an air conduction speaker configured to generate air conduction sound; and a second equalizer configured to perform equalizing processing on a signal input into the air conduction speaker.

According to a second aspect of the technology disclosed in this specification, the sound reproducing apparatus according to the first aspect is configured such that the first equalizer and the second equalizer perform equalizing processing on signals from the same sound source, respectively, and the vibration speaker and the air conduction speaker output sounds reproduced respectively at the same time.

According to a third aspect of the technology disclosed in this specification, the sound reproducing apparatus according to the first aspect is configured such that the first equalizer performs equalizing processing to remove a high range, and the vibration speaker outputs the bone conduction sound including low and middle range components.

According to a fourth aspect of the technology disclosed in this specification, the sound reproducing apparatus according to the first aspect is configured such that the second equalizer performs equalizing processing to remove low and middle ranges, and the air conduction speaker outputs the air conduction sound including a high range component.

According to a fifth aspect of the technology disclosed in this specification, the vibration speaker of the sound reproducing apparatus according to the first aspect is configured as a vibration speaker of a type in which a lowest resonance frequency F0 is low and a reproducible frequency band is wide.

According to a sixth aspect of the technology disclosed in this specification, the vibration speaker of the sound reproducing apparatus according to the first aspect is a dynamic type vibration speaker.

According to a seventh aspect of the technology disclosed in this specification, the air conduction speaker of the sound reproducing apparatus according to the first aspect is a speaker which can reproduce a high range or is small.

According to an eighth aspect of the technology disclosed in this specification, the air conduction speaker of the sound reproducing apparatus according to first aspect is a balanced armature type speaker.

According to a ninth aspect of the technology disclosed in this specification, the sound reproducing apparatus according to the first aspect further includes: a driver unit including the vibration speaker and the air conduction speaker; and a support unit configured to support the driver unit.

According to a tenth aspect of the technology disclosed in this specification, the support unit of the sound reproducing apparatus according to the ninth aspect is configured to support the driver unit such that the driver unit is pressed against a center direction of a head of a user with a certain pressure.

According to an eleventh aspect of the technology disclosed in this specification, the support unit of the sound reproducing apparatus according to the ninth aspect is configured to arrange the driver unit in the vicinity of a temple of a user.

According to a twelfth aspect of the technology disclosed in this specification, the air conduction speaker of the sound reproducing apparatus according to the ninth aspect is attached to a housing of the driver unit. Then, the support unit is configured to support the driver unit at a place spaced apart from an ear hole of a user.

According to a thirteenth aspect of the technology disclosed in this specification, the air conduction speaker of the sound reproducing apparatus according to the twelfth aspect is attached to the housing of the driver unit such that an output direction of the air conduction sound faces a substantially vertical direction of an auricle.

Effects of the Invention

According to the technology disclosed in this specification, it is possible to provide an ear-hole open type sound reproducing apparatus which can obtain good sound quality over a wide band while adopting the bone conduction system.

Note that the effects described in this specification are merely examples, and the effects of the present invention are not limited thereto. Moreover, in addition to the above effects, the present invention may further exert additional effects.

Still other objects, features and advantages of the technology disclosed in this specification will become apparent from a more detailed description based on the embodiments described later and the accompanying drawings.

MODE FOR CARRYING OUT THE INVENTION

Hereinafter, the embodiments of the technology disclosed in this specification will be described in detail with reference to the drawings.

Figure 1:
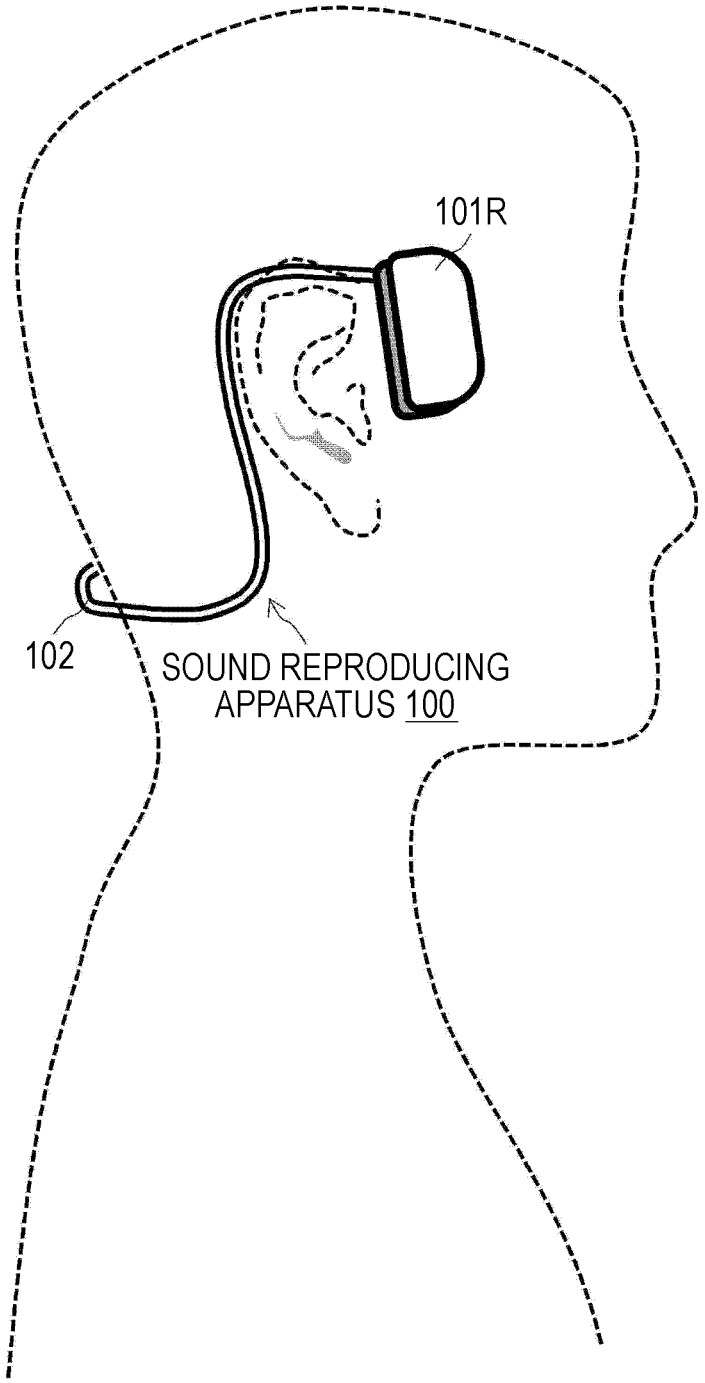
FIG. 1 is a view showing a state in which a sound reproducing apparatus 100 to which the technology disclosed in this specification is applied is worn on the head of a user.
Figure 2:
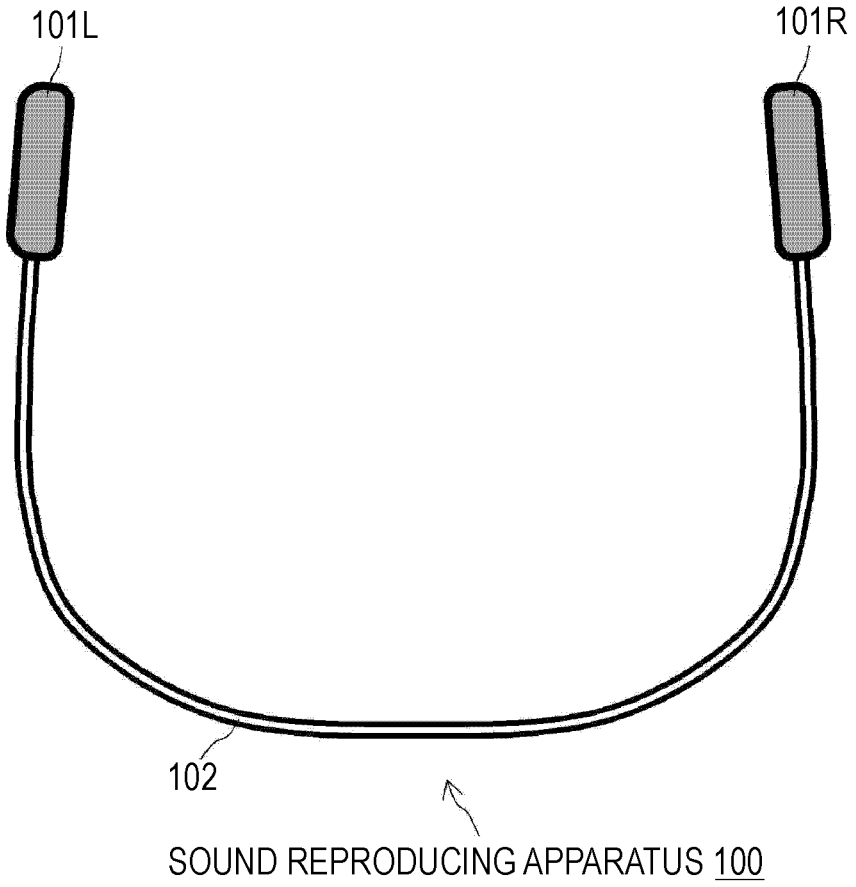
FIG. 2 is a view showing a state in which the sound reproducing apparatus 100 to which the technology disclosed in this specification is applied is viewed from the above.

FIG. 1 and FIG. 2 schematically show an exterior configuration example of a sound reproducing apparatus 100 to which the technology disclosed in this specification is applied. It is to be noted that, FIG. 1 shows a state in which the head of a user wearing the sound reproducing apparatus 100 is viewed from the right side, and FIG. 2 shows a state in which the sound reproducing apparatus 100 is viewed from the above.

As shown in the drawings, the sound reproducing apparatus 100 includes left and right driver units 101L and 101R and a support unit 102 which supports these driver units 101L and 101R at both ends, and has a substantially bilateral symmetrical structure. However, it is not indispensable that the exterior of the entire sound reproducing apparatus 100 including the support unit 102 has a bilateral symmetrical structure.

In the illustrated example, like a headband, the support unit 102 is configured such that it is wound around from the back portion of the head to the neck portion of the user to be used. However, it is also possible to configure the support unit 102 to be wound around through the top portion of the head.

The support unit 102 is a U-shaped structure body which has moderate elasticity and includes, for example, a synthetic resin such as polypropylene, or a metal such as aluminum, stainless steel, or titanium. As shown in FIG. 1, the support unit 102 can be wound around from the back portion of the head to the neck portion of the user so as to sandwich the head by widening the U-shape. At this time, a resilience for going back to the original U-shape occurs in the support unit 102. This resilience acts on both ends of the support unit 102 toward the inner side of the head of the user, thereby pressing the driver units 101L and 101R against the vicinities of the left and right temples (or the vicinities of the positions slightly forward from the tragi), respectively.

As can be seen from FIG. 1, each of the driver units 101L and 101R is disposed at a place spaced apart from the ear hole, and the sound reproducing apparatus 100 according to the present embodiment can be said to be an ear-hole open type.

Figure 13:
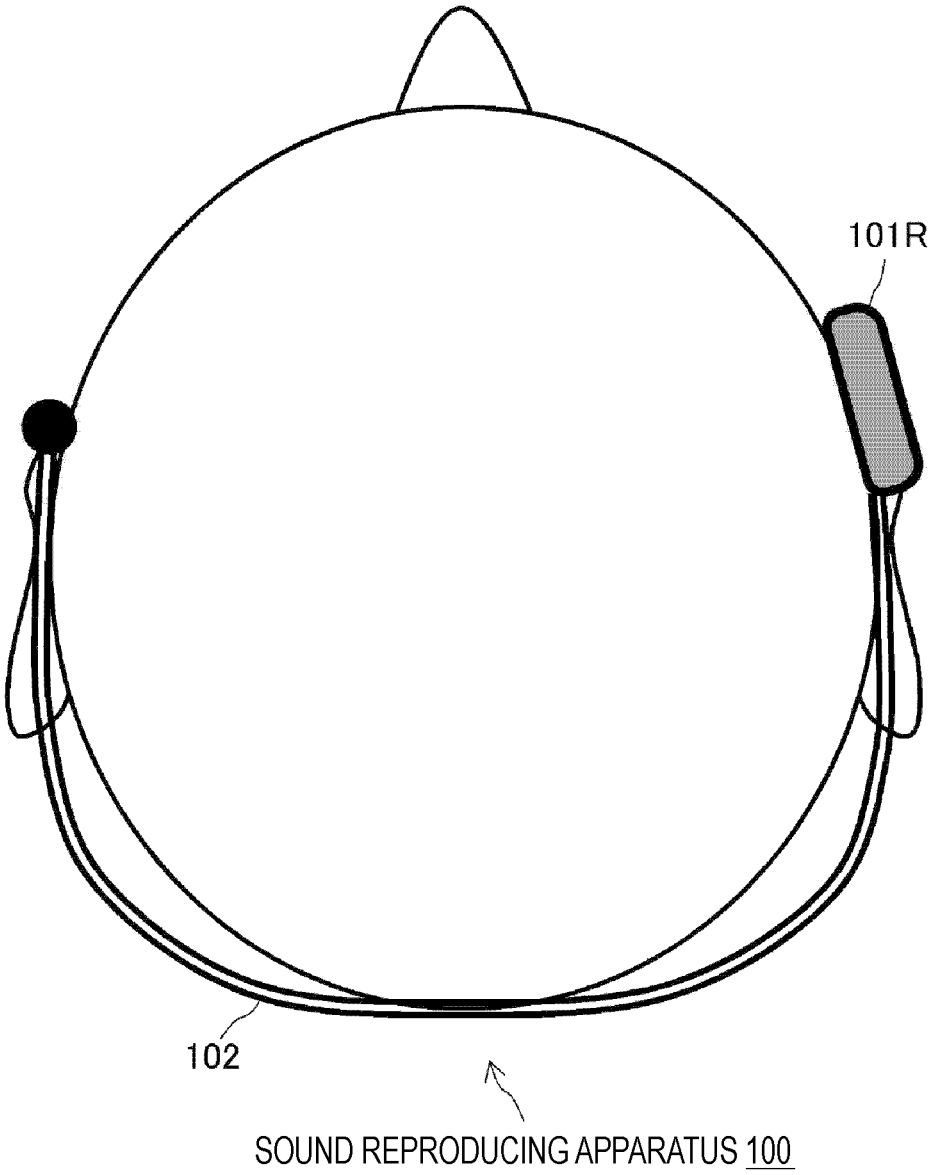
FIG. 13 is a view showing a modification example of the sound reproducing apparatus 100.

Note that it is not indispensable for the sound reproducing apparatus 100 to be equipped with the driver units 101L and 101R on both the left and right sides, and a configuration example in which only one of the left and right sides is equipped with the driver unit 101L or 101R (see FIG. 13) is also assumed.

Figure 3:
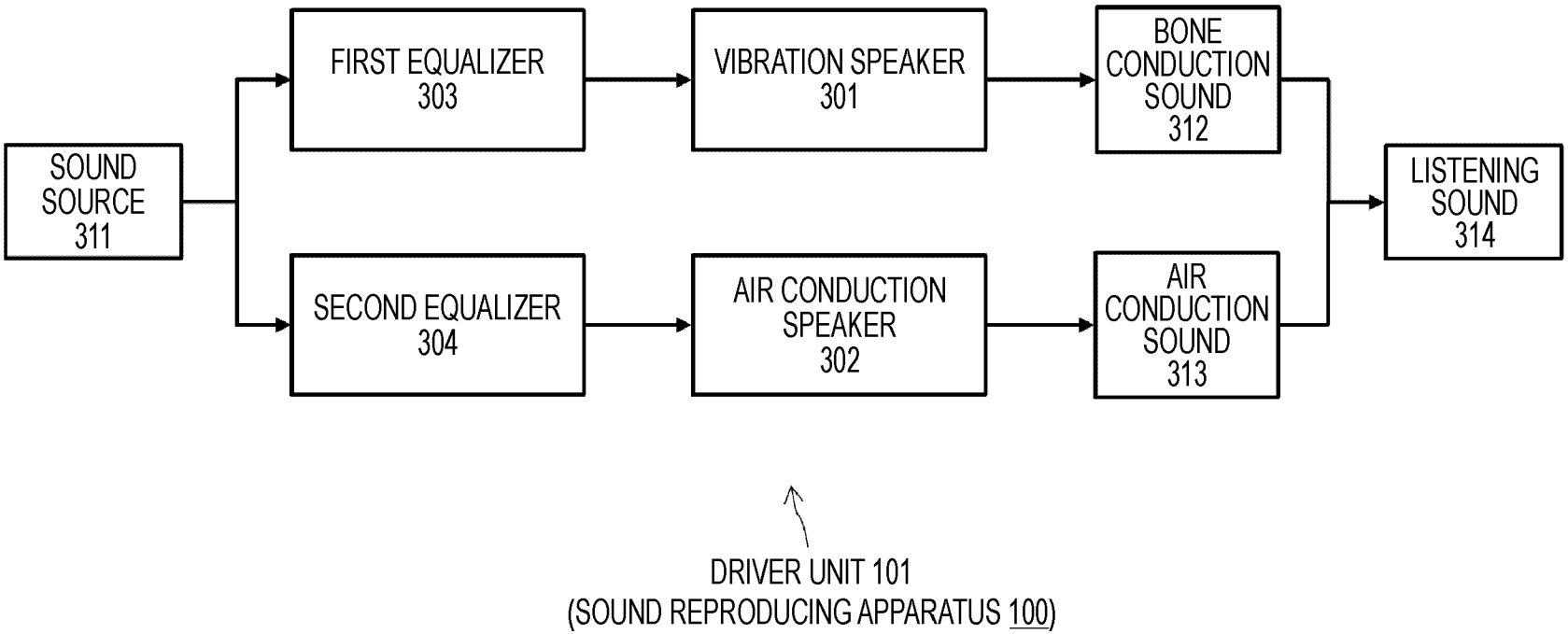
FIG. 3 is a diagram showing a functional configuration example of a driver unit 101.

FIG. 3 shows a functional configuration example of the driver unit 101. In the case of the sound reproducing apparatus 100 equipped with the driver units 101L and 101R on both the left and right sides, it is to be understood that both of the driver units 101L and 101R are also configured similarly.

The driver unit 101 includes a vibration speaker 301, an air conduction speaker 302, a first equalizer 303 and a second equalizer 302.

As a sound source 311 to the sound reproducing apparatus 100 (the driver unit 101), for example, sound reproduced by a portable music player, telephone sound from a cellular phone, or the like is assumed. For example, the sound reproducing apparatus 100 receives an acoustic electric signal from external devices (none are shown), such as a portable music player and a cellular phone, via a wired cable or wireless communication such as Bluetooth (registered trademark).

The first equalizer 303 performs equalizing processing for the vibration speaker 301 on the acoustic electric signal. The vibration speaker 301 converts the acoustic electrical signal into mechanical vibration. As described above, since the driver unit 101 is pressed against the vicinity of the temple of the user, the vibration generated by the vibration speaker 301 is conveyed as a bone conduction sound 312 through the skull in the vicinity of the temple. Then, when the bone conduction sound 312 stimulates the organs of the inner ear such as a cochlea, the cochlea converts the bone conduction sound 312 into an electric signal to be conveyed to the brain, and the user recognizes the electric signal as a listening sound 314.

Moreover, the second equalizer 304 performs equalizing processing for the air conduction speaker 302 on the acoustic electric signal. The air conduction speaker 301 converts the acoustic electric signal into aerial vibration. As can be seen also from FIG. 1, since the driver unit 101 is disposed in the vicinity of the ear hole of the user, the aerial vibration generated by the air conduction speaker 302 is conveyed as an air conduction sound 313 to the eardrum from the ear hole through the external auditory canal. Then, when the air conduction sound 313 stimulates the organs of the inner ear such as a cochlea, the cochlea converts the air conduction sound 313 into an electric signal to be conveyed to the brain, and the user recognizes the electric signal as the listening sound 314.

The main feature of the sound reproducing apparatus 100 according to the present embodiment is that the vibration speaker 301 and the air conduction speaker 302 respectively reproduce the bone conduction sound 312 and the air conduction sound 313 at the same time to be heard in hybrid.

Examples of the vibration speaker 301 which transmits the sound as the vibration to the bone include forms of a dynamic type, a piezoelectric type, a magnetostrictive type and the like. Similarly to the ordinary speaker, the dynamic type is a form which utilizes the driving force by the electromagnetic force acting between a coil and a magnet. Moreover, the piezoelectric type is a form which obtains the driving force by the inverse piezoelectric effect by applying a voltage to a piezoelectric ceramic. Furthermore, the magnetostrictive type is a form which utilizes, as the driving force, expansion/contraction (Joule effect) due to a magnetic field change of a super magnetostrictive element.

Figure 4:
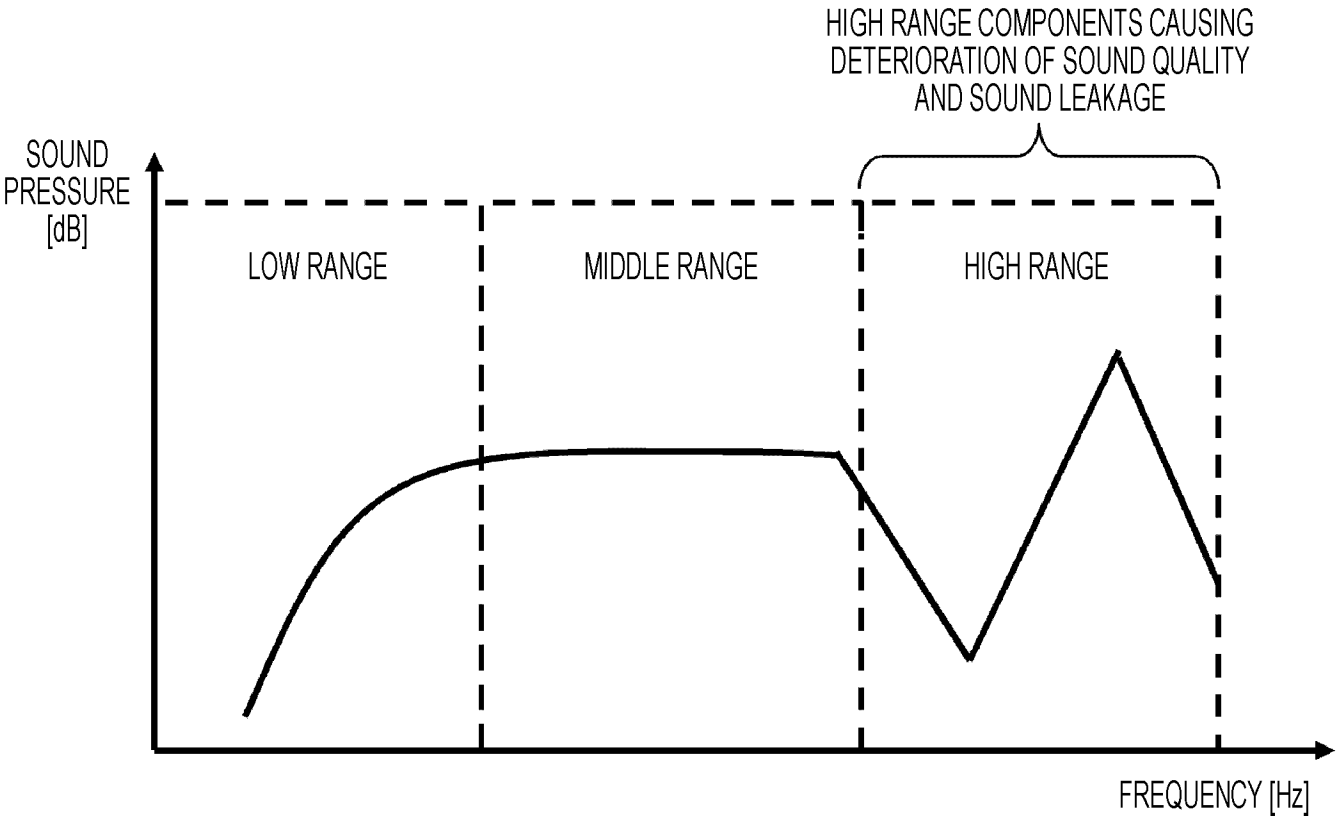
FIG. 4 is a diagram showing an example of the characteristics of a dynamic type vibration speaker.

The vibration speakers of all the forms generally have a narrow reproducible frequency band, and the sound reproducing apparatus of the bone conduction system have a problem that it is inferior to the sound reproducing apparatus of the air conduction system in terms of sound quality. FIG. 4 shows an example of the characteristics of the dynamic type vibration speaker. This drawing shows the measurements of the vibration acceleration of a weight of 100 grams excited by an actuator, in which the horizontal axis is the frequency [Hz], and the vertical axis is the vibration acceleration level [dB]. When the lowest resonance frequency F0 of the dynamic type vibration speaker is lowered, unnecessary resonance occurs in a high range of 5000 Hz or more. This resonance causes deterioration of sound quality and sound leakage. The sound leakage of the high range is, for example, noise that can be heard as a "high-pitched rustle."

In short, the vibration speaker 301 cannot reproduce high range components with high sound quality. Moreover, the bone conduction sound 312 has a feature that the high frequency components attenuate when propagating soft tissue with low eigenfrequency, such as cartilage and muscle. For these reasons, it can be said that the high frequency components are difficult to be regenerated as the bone conduction sounds.

Thereupon, the sound reproducing apparatus 100 according to the present embodiment is configured as a hybrid type in combination with the air conduction speaker 302 in order to interpolate the high range components which are difficult or impossible to be reproduced by the vibration speaker 301.

The first equalizer 303 performs equalizing processing so as to remove unnecessary resonance noise components (see FIG. 4) generated in the high range of 5000 Hz or more. By this equalizing processing, it is possible to output the bone conduction sound with good sound quality over the low range to the middle range from the vibration speaker 301 and adjust the high frequency components of the bone conduction sound to be small. As a result, it is possible to suppress the vibration of the housing of the driver unit in the high range and reduce the sound leakage that can be heard as, for example a "high-pitched rustle."

On the other hand, the second equalizer 304 performs equalizing processing so as to remove components over the low range to the middle range that can be conveyed by the bone conduction. Therefore, it is possible to input the equalizing processed signal into the air conduction speaker 302 and convey the sound of the high range components with high sound quality, which is not output from the vibration speaker 301, by the air conduction sound.

Figure 5:
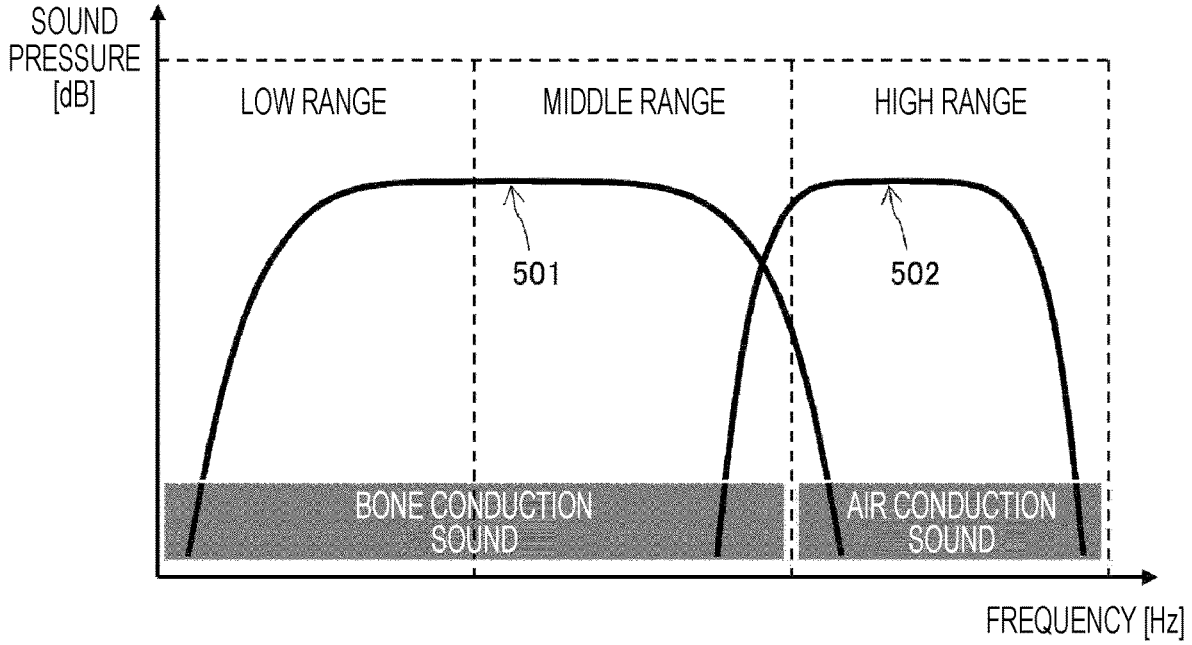
FIG. 5 is a diagram showing the waveform equalization characteristics of a first equalizer 303 and a second equalizer 304.

FIG. 5 schematically shows the waveform equalization characteristics of the first equalizer 303 and the second equalizer 304. It is to be noted that the horizontal axis is the frequency [Hz], and the vertical axis is the sound pressure [dB]. As can be seen also from this drawing, the first equalizer 303 performs equalizing processing so as to remove the high range components from the bone conduction sound as indicated by the reference numeral 501. On the other hand, the second equalizer 304 performs equalizing processing so as to remove the components over the low range to the middle range from the air conduction sound as indicated by the reference numeral 502. The first equalizer 303 can also be said to be a low and middle range transmission filter, and the second equalizer 304 can also be said to be a high range transmission filter. Therefore, it is to be understood that it is possible to subject the sound of the wide range over the low range to the high range to the waveform equalization when both are combined.

The vibration speaker 301 reproduces the low and middle ranges of 50 to 5000 Hz from which the high range components have been removed by the first equalizer 303. As previously mentioned, the examples of the vibration speaker 301 include the respective forms of the dynamic type, the piezoelectric type, the magnetostrictive type, and the like. In consideration of reproducing the low to middle ranges of 50 to 5000 Hz, the applicant considers that the dynamic type, in which the lowest resonance frequency F0 is low and the reproducible frequency band is wide, is suitable for the vibration speaker 301. Of course, if the acoustic characteristics are improved in the future, it is also assumed that the vibration speaker of the piezoelectric type or the magnetostrictive type is adopted.

Moreover, the air conduction speaker 302 reproduces the high range of 5 kHz or more from which the low and middle range components have been removed by the second equalizer 304. Examples of the air conduction speaker 302 include forms of a dynamic type, a balanced armature type, and the like. In general, the dynamic type speaker exhibits the low range components well (as the diaphragm is made larger). The balanced armature type speaker on the other hand conveys the vibration of the iron piece to the diaphragm by a thin rod (drive rod) to vibrate, and good sound quality (with a sense of resolution) can be obtained in the high range. Moreover, since the balanced armature type speaker can be made in a small size, constraints on the element arrangements are small, and the best element arrangements can be easily realized even in a hybrid type. The applicant considers that balanced armature type is suitable for the air conduction speaker 302 from the viewpoint that the high range can be output and the size is small. Of course, if the miniaturization advances in the future and constraints on the element arrangements become smaller, it is also assumed that the air conduction speaker of the dynamic type is adopted.

Figure 6:
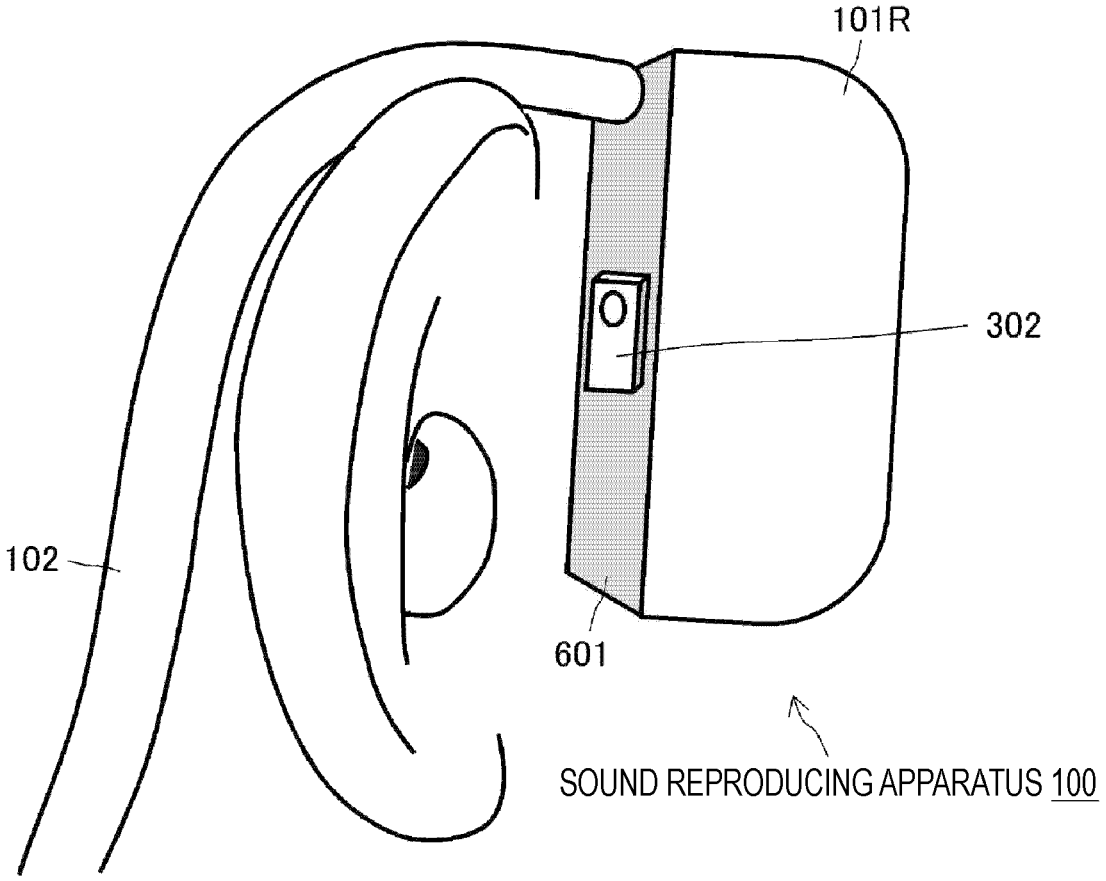
FIG. 6 is a view showing a state in which a driver unit 101R on the right side is attached to the vicinity of the temple on the right side of the head of the user.

FIG. 6 shows a state in which the driver unit 101R on the right side is attached to the vicinity of the temple on the right side of the head of the user (or the vicinity of the position slightly forward from the tragus of the right ear).

In order to vibrate the skull with the vibration sound generated by the vibration speaker 301, it is necessary to press the driver unit 101R incorporating the vibration speaker 301 (not shown in FIG. 6) against the center direction of the head with a certain pressure. In the present embodiment, the driver unit 101R as well as the driver unit 101L on the left side are attached to both ends of the U-shaped support unit 102 having moderate elasticity. Then, the support unit 102 is wound around from the back portion of the head to the neck portion of the user so as to sandwich the head by widening the U-shape (see FIG. 1). Therefore, since the driver unit 101R is pressed against the center direction of the head with a moderate pressure by the resilience of the support unit 102, the bone conduction sound generated by the vibration speaker 301 is conveyed through the skull in the vicinity of the temple. Moreover, since the driver unit 101R is disposed at a place spaced apart from the ear hole, the sound reproducing apparatus 100 can be said to be an ear-hole open type.

On the other hand, the air conduction speaker 302 is attached to a side edge 601 of the housing of the driver unit 101R closest to the auricle direction so that the output direction of the air conduction sound faces the substantially vertical direction (or the direction of the ear hole) of the auricle. In general, high frequency vibration has good directivity and greatly attenuates. Therefore, as shown in FIG. 6, the air conduction speaker 302 faces the substantially vertical direction of the auricle, and thereby the air conduction sound of the high range of 5000 Hz or more can be efficiently conveyed to the ear hole. Furthermore, since the air conduction speaker 302 outputs the air conduction sound toward the auricle, sound leakage to the surroundings can be reduced.

The sound reproducing apparatus 100 is an ear-hole open type in which the driver unit 101R is arranged at a place spaced apart from the ear hole, but the air conduction speaker 302 is at a position with a short distance from the ear hole. Thus, the air conduction sound with great attenuation can be directly delivered to the ear hole without a sound guiding pipe. The headphones of the bone conduction type used by being pressed against the ear-rear or the nasal bone other than the temples have also been known. However, if the air conduction speaker is disposed at a place with a long distance from the ear hole, such as the ear-rear or the nasal bone, it is necessary to propagate the air conduction sound by using the sound guiding pipe, causing a problem that the air conduction sound of the high range attenuates while propagating through the sound guiding pipe. In other words, from the viewpoint of generating the air conduction sound of the high range from the air conduction speaker 302, it can be said that it is more preferable that the sound reproducing apparatus 100 have a structure in which the driver unit 101R is disposed in the vicinity of the temple.

The main feature of the sound reproducing apparatus 100 according to the present embodiment is that the vibration speaker in contact with head of the user and the air conduction speaker facing the vertical direction of the auricle respectively reproduce the bone conduction listening sound and the air conduction listening sound at the same time to hybridize the sounds. As compared with the conventional headphones for only the bone conduction listening sound, and the like, the sound reproducing apparatus 100 according to the present embodiment has advantages that music with high sound quality in a wide range over the low range to the high range (50 Hz to 20 kHz) can be reproduced and sound leakage of the high range (5000 Hz to 20 kHz) can be reduced.

The sound reproducing apparatus 100 according to the present embodiment is utilized as, for example, ear-hole open type headphones and can receive audio signals from external devices, such as sound reproduced by a portable music player and telephone sound from a cellular phone, via a wired cable or wireless communication such as Bluetooth (registered trademark) to output the sounds. Alternatively, the sound reproducing apparatus 100 according to the present embodiment is utilized as a portable player, in which a memory is mounted therein, and can output the sound reproduced therein.

Finally, modification examples of the sound reproducing apparatus 100 will be described.

As a mode of wearing the sound reproducing apparatus 100, the configuration examples, in which the U-shaped support unit 102, which supports the driver units 101L and 101R at both ends, is wound around from the back portion of head to the neck portion of the user so as to sandwich the head by widening the U-shape, or wound around through the top of the head, have been described, but the mode of wearing is not limited thereto. As long as the structure is such that the vibration speaker is brought into contact with the head of the user while keeping the ear hole open, and the air conduction speaker is held so that the air conduction sound is output in the direction of the ear hole, various modes of wearing can be adopted, such as an over headphone type, an eyeglass type, a headband type and a helmet type.

Figure 7:
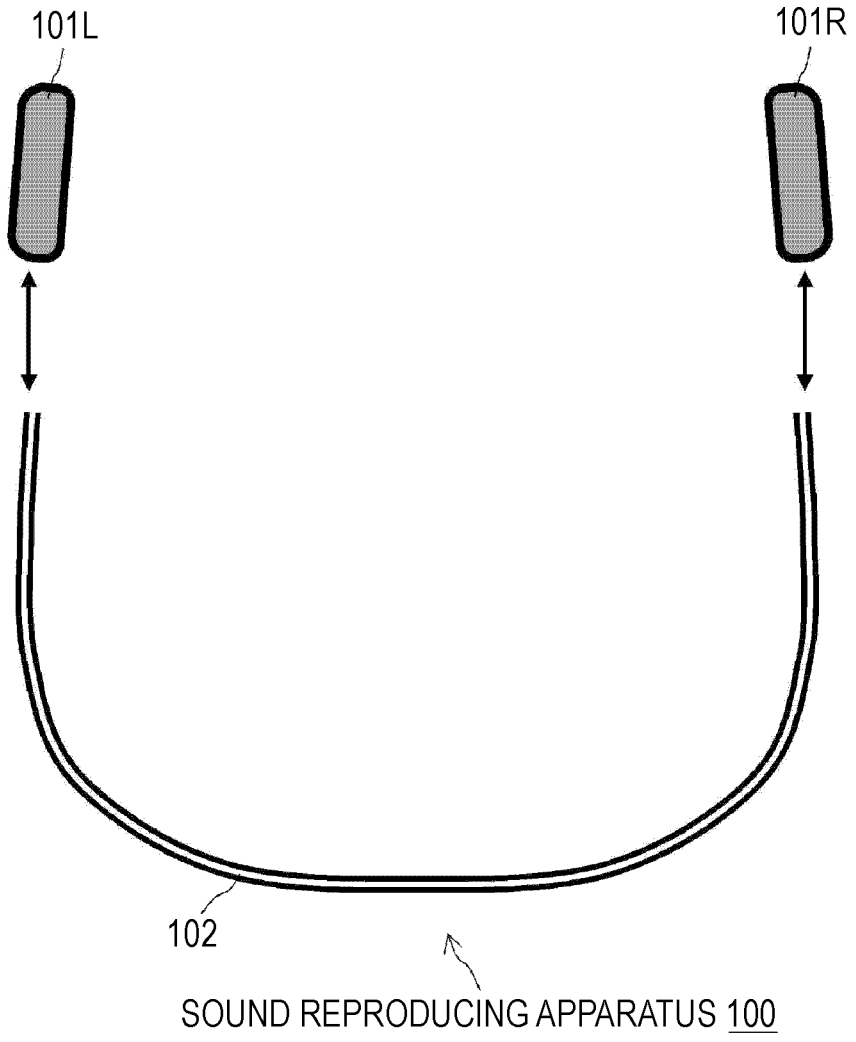
FIG. 7 is a view showing a modification example of the sound reproducing apparatus 100.

Moreover, as shown in FIG. 7, it is also possible to configure at least one of the left and right driver units 101L or 101R to be detached from the support unit 102 to be replaced. For example, the user can use the sound reproducing apparatus 100 by replacing the driver unit with a driver unit having his/her favorite acoustic characteristics.

Figure 8:
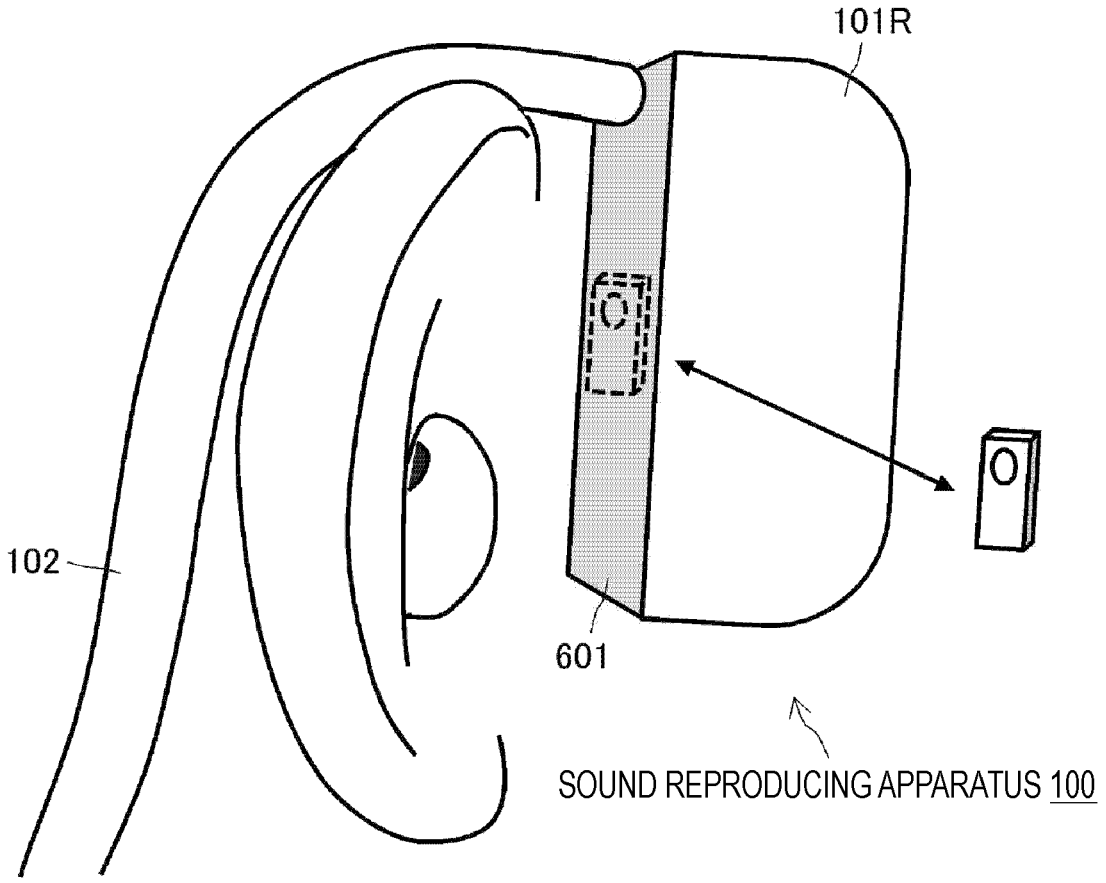
FIG. 8 is a view showing a modification example of the sound reproducing apparatus 100.

Furthermore, as shown in FIG. 8, it is also possible to configure at least one of the left and right driver units 101L or 101R such that the air conduction speaker 302 can be detached and replaced. For example, the user can use the sound reproducing apparatus 100 by replacing the air conduction speaker with an air conduction speaker having his/her favorite acoustic characteristics in the high range.

Still further, paying attention to the sound reproducing apparatus 100 configured such that the low and the middle ranges and the high range from the same sound source 311 are separated and output respectively from the vibration speaker 301 and the air conduction speaker 302 as shown in FIG. 3, the sound reproducing apparatus 100 can also be configured to individually adjust the sound volumes of the low and middle ranges and the high range of the same sound source 311.

Figure 9:
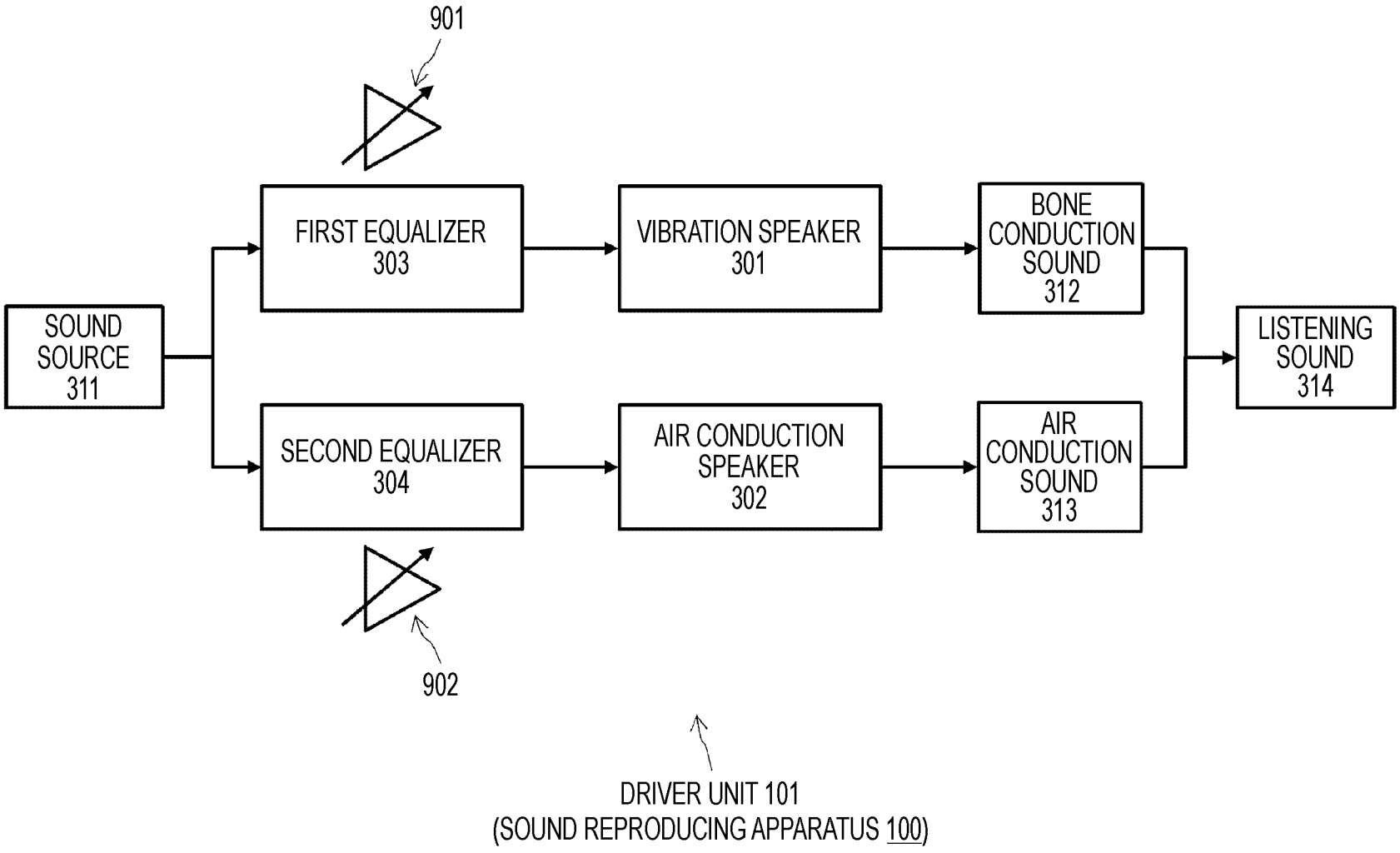
FIG. 9 is a diagram showing a modification example of the sound reproducing apparatus 100.
Figure 10:
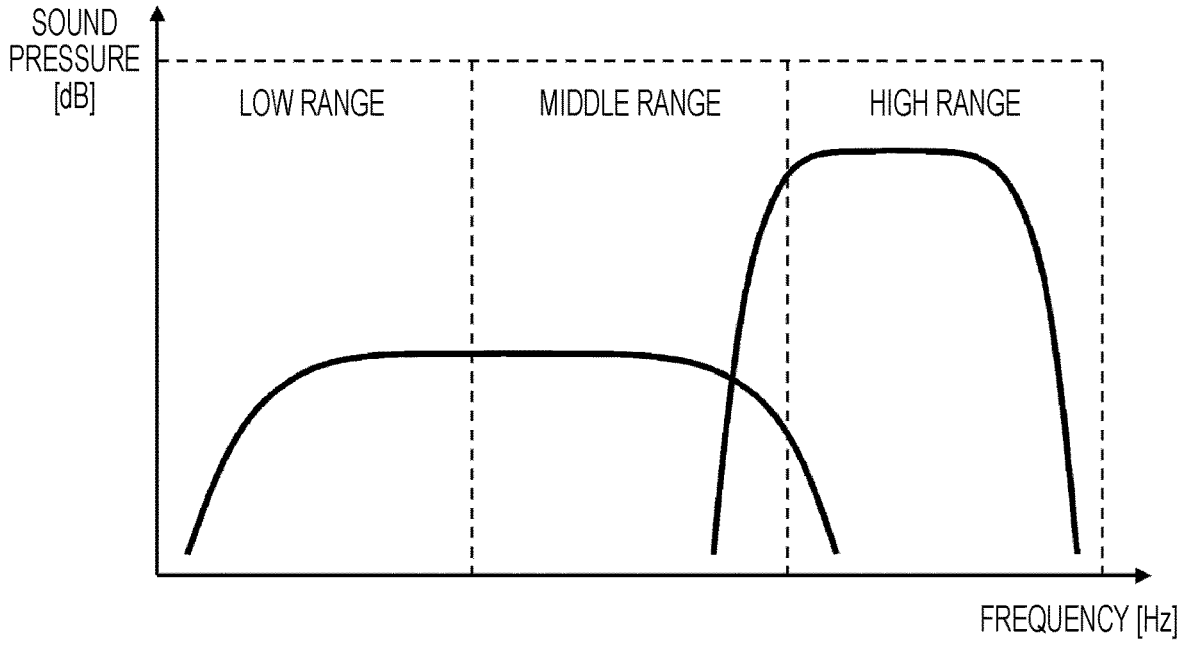
FIG. 10 is a diagram showing a modification example of the sound reproducing apparatus 100.
Figure 11:
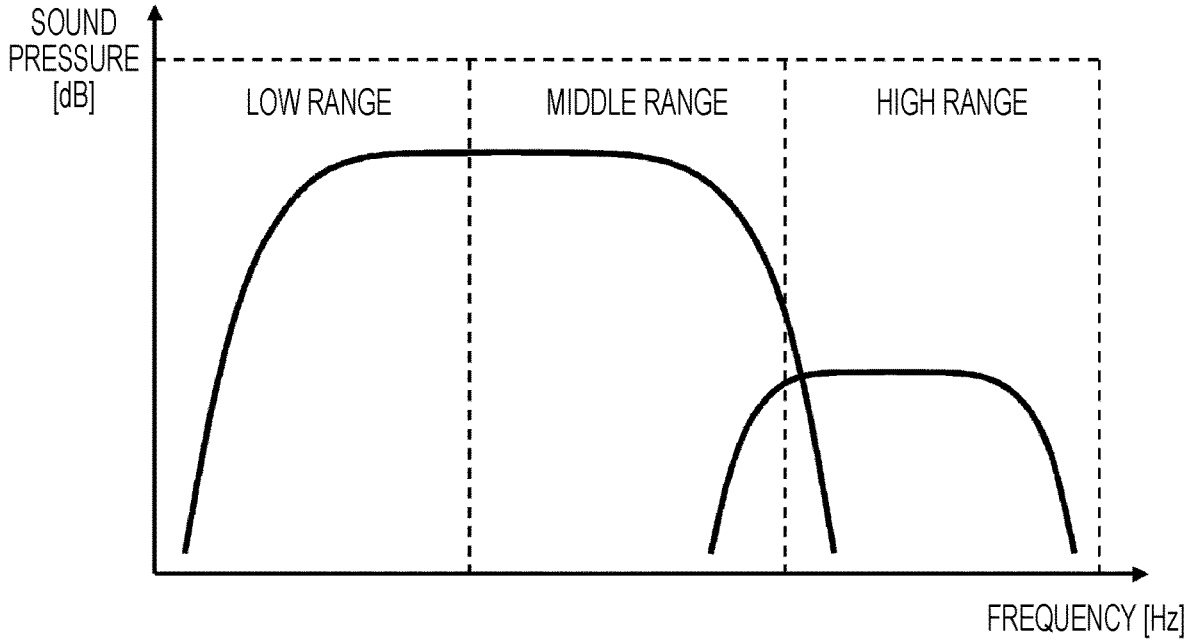
FIG. 11 is a diagram showing a modification example of the sound reproducing apparatus 100.

For example, as shown in FIG. 9, a variable gain amplifier 901 may be provided in a first equalizer 303 to adjust the sound volumes of the low and middle ranges, and a variable gain amplifier 902 may also be provided in a second equalizer 304 to be able to adjust the sound volume of the high range. By controlling the gain of each of the variable gain amplifiers 901 and 902, as shown in FIG. 10, the waveform equalization characteristics with the suppressed low and middle ranges (or the promoted high range) are obtained, and the sound volume of the high range can be increased. Conversely, as shown in FIG. 11, the waveform equalization characteristics with the suppressed high range (or the promoted low and middle ranges) are obtained, and the sound volumes of the low and middle ranges can be increased. Of course, the variable gain amplifier 901 or 902 may be disposed in only one of the first equalizer 303 or the second equalizer 304.

In addition, the example, in which the external device such as the portable music player or the cellular phone is assumed as the sound source of the sound reproducing apparatus 100 and the acoustic electric signal from the external device is received via the wired cable or the wireless communication, has been mentioned, but the sound source is not limited thereto. For example, the sound reproducing apparatus 100 may include a function of a sound source such as a music player or a cellular phone (e.g., in the driver units).

Moreover, safe music reproduction without closing the ears, which is assumed to be the use case of the sound reproducing apparatus 100, has been described above, but the use case is not limited thereto. For example, it can be considered that a microphone is further mounted on the sound reproducing apparatus 100 so that the sound reproducing apparatus 100 is also utilized as a sound collector (IC recorder), applied as a communication tool and the like in a noisy environment such as a construction site.

Furthermore, since the sound reproducing apparatus 100 has an aspect as a wearable apparatus to be attached to a human body to be used, the sound reproducing apparatus 100 may further be equipped with a biosensor to detect biological information. Examples of the biosensor include a body temperature sensor, a perspiration sensor, a myoelectric sensor, a pulse sensor, a gyro and the like.

Still further, the sound reproducing apparatus 100 may be further equipped with a wearing sensor to drive the vibration speaker and the air conduction speaker only in a wearing state of being attached to the head of the user and to stop the operations of the vibration speaker and the air conduction speaker in a non-wearing state. By stopping the operations in the non-wearing state, it is possible to achieve low power consumption as well as prevent noise due to the vibration of the housings of the driver units. Incidentally, examples of the wearing sensor include an illuminance sensor, a pressure sensor, a proximity sensor, an energization sensor, a mechanical switch and the like. In addition, a part of the biosensor described above can also be used as the wearing sensor.

Figure 12:
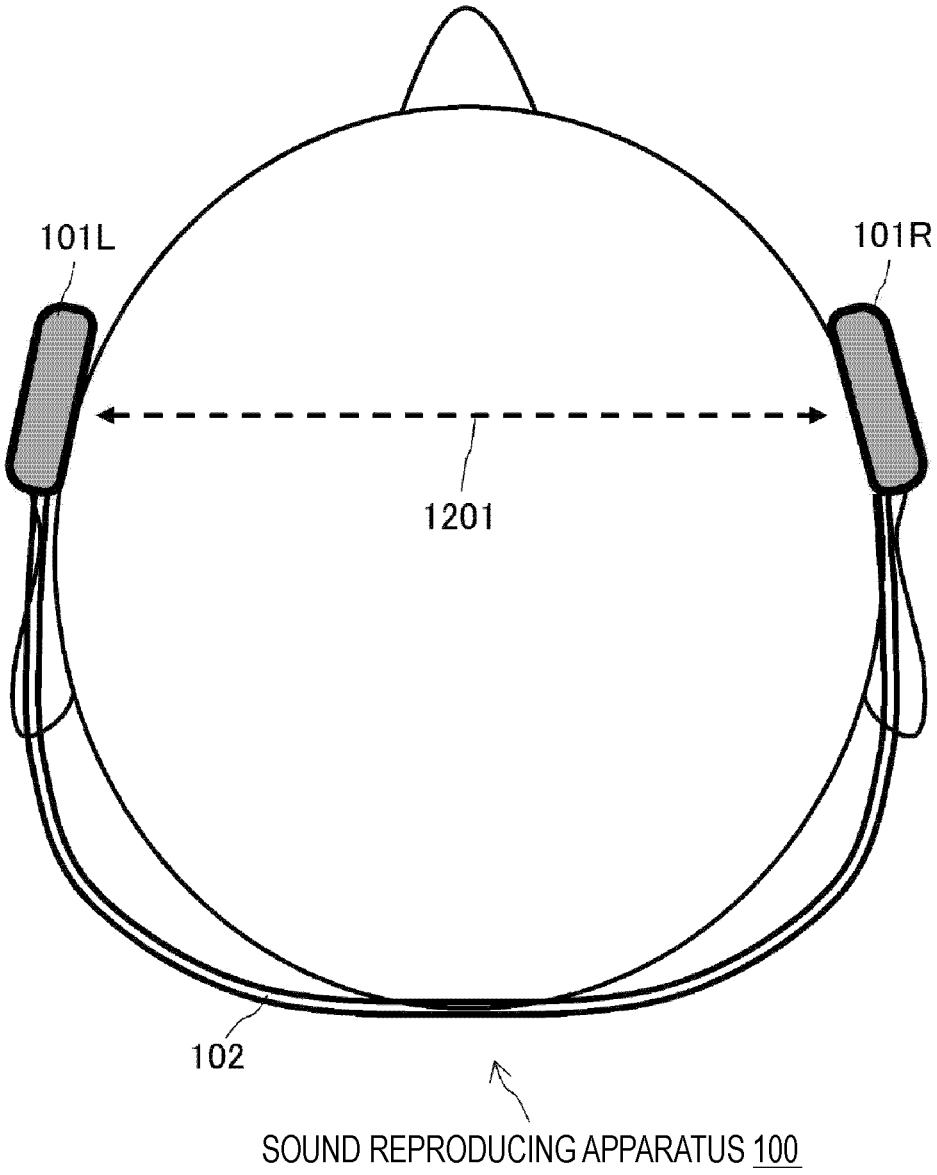
FIG. 12 is a view showing a modification example of the sound reproducing apparatus 100.

Herein, supplementary description will be given to the case where the energization sensor is mounted on the sound reproducing apparatus 100. For example, each of the left and right driver units 101L and 101R is equipped with a transceiver, and the sound reproducing apparatus 100 is detected to be worn on the head (human body) of the user by sending and receiving an electric signal 1201 between the driver units 101L and 101R as shown in FIG. 12. Moreover, it is also possible to perform biometric communication between the driver units 101L and 101R.

INDUSTRIAL APPLICABILITY

The technology disclosed in this specification has been described above in detail with reference to specific embodiments. However, it is obvious that those skilled in the art can make modifications and substitutions of the embodiments in a scope without departing from the gist of the technology disclosed in this specification.

The sound reproducing apparatus to which the technology disclosed in this specification is applied is used by being worn on the ears of the listener, but differs greatly from the conventional earphones in terms of "ear-hole open type." Therefore, the features of the sound reproducing apparatus to which the technology disclosed in this specification is applied are that the sound reproducing apparatus can realize listening characteristics of the ambient sound also in a wearing state, which are equivalent to those in a non-wearing state, and output acoustic information at the same time and that the ear holes of the listener appear not to be closed to the people around even in the wearing state. By taking advantage of such features, the sound reproducing apparatus to which the technology disclosed in this specification is applied can be applied to the fields of various sports (during play, remote coaching and the like) performed outdoors, such as walking, jogging, cycling, climbing, skiing and snowboarding, and indoors, the field of communication or presentation which requires listening to the ambient sound and presenting the audio information at the same time (e.g., supplementary information at the time of watching a play, audio information presentation in museums, bird watching (cry listening) and the like), driving or navigation, security guards, newscasters and the like.

In short, the technology disclosed in this specification has been described in the form of exemplification, and the contents of the description in this specification should not be interpreted strictly. To judge the gist of the technology disclosed in this specification, the scope of claims should be taken into consideration.

Note that the technology disclosed in this specification can also adopt the following configurations.

(1) A sound reproducing apparatus including:

a vibration speaker configured to generate bone conduction sound;

a first equalizer configured to perform equalizing processing on a signal input into the vibration speaker;

an air conduction speaker configured to generate air conduction sound; and a second equalizer configured to perform equalizing processing on a signal input into the air conduction speaker.

(2) The sound reproducing apparatus according to (1), in which the first equalizer and the second equalizer perform equalizing processing on signals from the same sound source, respectively, and the vibration speaker and the air conduction speaker output sounds reproduced respectively at the same time.

(3) The sound reproducing apparatus according to (1), in which the first equalizer performs equalizing processing to remove a high range, and the vibration speaker outputs the bone conduction sound including low and middle range components.

(4) The sound reproducing apparatus according to (1), in which the second equalizer performs equalizing processing to remove low and middle ranges, and the air conduction speaker outputs the air conduction sound including a high range component.

(5) The sound reproducing apparatus according to (1), in which the vibration speaker is a vibration speaker of a type in which a lowest resonance frequency F0 is low and a reproducible frequency band is wide.

(6) The sound reproducing apparatus according to (1), in which the vibration speaker is a dynamic type vibration speaker.

(7) The sound reproducing apparatus according to (1), in which the air conduction speaker is a speaker which is capable of reproducing a high range or is small.

(8) The sound reproducing apparatus according to (1), in which the air conduction speaker is a balanced armature type speaker.

(9) The sound reproducing apparatus according to (1), further including:

a driver unit including the vibration speaker and the air conduction speaker; and a support unit configured to support the driver unit.

(10) The sound reproducing apparatus according to (9), in which the support unit supports the driver unit such that the driver unit is pressed against a center direction of a head of a user with a certain pressure.

(11) The sound reproducing apparatus according to (9), in which the support unit arranges the driver unit in the vicinity of a temple of a user.

(12) The sound reproducing apparatus according to (9), in which the air conduction speaker is attached to a housing of the driver unit, and the support unit supports the driver unit at a place spaced apart from an ear hole of a user.

(13) The sound reproducing apparatus according to (12), in which the air conduction speaker is attached to the housing of the driver unit such that an output direction of the air conduction sound faces a substantially vertical direction of an auricle.

REFERENCE SIGNS LIST

100 Sound reproducing apparatus
101L, 101R Driver unit
102 Support unit (headband)
301 Vibration Speaker
302 Air conduction speaker
303 First equalizer
304 Second equalizer
901, 902 Variable gain amplifier

The invention claimed is:

1. A sound reproducing apparatus, comprising:

a driver unit that includes:

a vibration speaker, wherein the vibration speaker is a magnetostrictive type vibration speaker;

a first equalizer configured to:

execute a first equalizing process on a first signal; and input the first signal into the vibration speaker based on the execution of the first equalizing process, wherein the vibration speaker is configured to output bone conduction sound based on the first signal input into the vibration speaker;

an air conduction speaker; and a second equalizer configured to:

execute a second equalizing process on a second signal; and input the second signal into the air conduction speaker based on the execution of the second equalizing process, wherein the air conduction speaker is configured to output air conduction sound based on the second signal input into the air conduction speaker;

a support unit configured to support the driver unit, wherein the support unit includes polypropylene, the driver unit is detachable from the support unit, and the air conduction speaker is detachable from the driver unit;

a wearing sensor configured to:

drive the vibration speaker and the air conduction speaker in a wearing state of the sound reproducing apparatus; and stop operations of the vibration speaker and the air conduction speaker in a non-wearing state of the sound reproducing apparatus; and a biosensor configured to detect biological information of a user, wherein the biosensor is one of a myoelectric sensor, a pulse sensor, or a gyro sensor.

2. The sound reproducing apparatus according to claim 1, wherein the first signal and the second signal are from a same sound source, and the vibration speaker and the air conduction speaker are further configured to output the bone conduction sound and the air conduction sound, respectively, at a same time.

3. The sound reproducing apparatus according to claim 1, wherein the first equalizer is further configured to execute the first equalizing process to remove high range components of the first signal, and the vibration speaker is further configured to output the bone conduction sound including low range components and middle range components.

4. The sound reproducing apparatus according to claim 1, wherein the second equalizer is further configured to execute the second equalizing process to remove low range components and middle range components of the second signal, and the air conduction speaker is further configured to output the air conduction sound including high range components.

5. The sound reproducing apparatus according to claim 1, wherein the air conduction speaker is further configured to reproduce high range components.

6. The sound reproducing apparatus according to claim 1, wherein the air conduction speaker is a balanced armature type speaker.

7. The sound reproducing apparatus according to claim 1, wherein the support unit is further configured to support the driver unit such that the driver unit is pressed against a center direction of a head of the user with a certain pressure.

8. The sound reproducing apparatus according to claim 1, wherein the support unit is further configured to arrange the driver unit in a vicinity of a temple of the user.

9. The sound reproducing apparatus according to claim 1, wherein the air conduction speaker is attachable to a housing of the driver unit, and the support unit is further configured to support the driver unit at a position spaced apart from an ear hole of the user.

10. The sound reproducing apparatus according to claim 9, wherein the air conduction speaker is attachable to the housing of the driver unit such that an output direction of the air conduction sound faces a vertical direction of an auricle.

* * * * *